US010549960B2

(12) United States Patent
Moose et al.

(10) Patent No.: US 10,549,960 B2
(45) Date of Patent: Feb. 4, 2020

(54) MULTIPLE POSITION A-FRAME OUTRIGGERS

(71) Applicant: Manitowoc Crane Companies, LLC, Manitowoc, WI (US)

(72) Inventors: Ryan Moose, Fayetteville, PA (US); John Fremont Benton, Smithsburg, MD (US)

(73) Assignee: Manitowoc Crane Companies, LLC, Milwaukee, WI (US)

( * ) Notice: Subject to any disclaimer, the term of this patent is extended or adjusted under 35 U.S.C. 154(b) by 0 days.

(21) Appl. No.: 16/059,870

(22) Filed: Aug. 9, 2018

(65) Prior Publication Data

US 2019/0047831 A1 Feb. 14, 2019

Related U.S. Application Data

(60) Provisional application No. 62/543,454, filed on Aug. 10, 2017.

(51) Int. Cl.
*B66C 23/36* (2006.01)
*B66C 23/78* (2006.01)

(52) U.S. Cl.
CPC ..... *B66C 23/36* (2013.01); *B66C 23/78* (2013.01)

(58) Field of Classification Search
CPC ..... E02F 9/08; E02F 9/08; E02F 9/085; B60S 9/00; B60S 9/10; B60S 9/12; B60S 9/22; E04G 21/00; B66C 25/00; B66C 23/78; B66C 23/80
See application file for complete search history.

(56) References Cited

U.S. PATENT DOCUMENTS

| | | | | |
|---|---|---|---|---|
| 3,690,694 | A * | 9/1972 | Herndon | B60P 3/36 280/763.1 |
| 3,801,128 | A * | 4/1974 | Herndon | B60P 3/36 280/763.1 |
| 3,933,372 | A * | 1/1976 | Herndon | B60P 3/36 280/763.1 |
| 4,596,404 | A * | 6/1986 | F'Geppert | E02F 9/085 172/484 |
| 7,150,472 | B1 * | 12/2006 | Schneider | B66C 23/80 280/766.1 |
| 7,594,679 | B1 * | 9/2009 | Schneider | B66C 23/80 280/763.1 |
| 2012/0261213 | A1 * | 10/2012 | St-Yves | B60S 9/12 182/64.1 |

FOREIGN PATENT DOCUMENTS

| | | | | |
|---|---|---|---|---|
| FR | 2217257 | * | 2/1974 | B66C 23/78 |

* cited by examiner

*Primary Examiner* — Michael R Mansen
*Assistant Examiner* — Juan J Campos, Jr.
(74) *Attorney, Agent, or Firm* — Levenfeld Pearlstein, LLC

(57) ABSTRACT

A variable span A-frame outrigger includes a support having a first pivoting mount and a second pivoting mount. The first pivoting mount is pivotably connected to an outrigger leg having an upper segment and a lower segment that extends from the upper segment. The lower segment has a first plurality of connection points for connection to an intermediate member. The second pivoting mount is pivotably connected to the intermediate member having a second plurality of connection points. A connector connects a connection point of the first plurality of connection points to a connection point of the second plurality of connection points.

18 Claims, 9 Drawing Sheets

MULTIPLE POSITION A-FRAME OUTRIGGERS

FIELD

The present disclosure generally relates to cranes and more particularly to crane outriggers.

BACKGROUND

A mobile crane in the form of a truck mounted crane typically includes a transport chassis and a superstructure coupled to the transport chassis. The superstructure typically includes an extendable boom. In transport, the crane is supported by the chassis on its axles and tires. At times, the crane needs to be stabilized beyond what can be provided while resting on the tires of the transport chassis. In order to provide stability and support of the crane during lifting operations, it is well known to provide the chassis with an outrigger system. An outrigger system will normally include at least two (often four or more) outriggers for supporting the crane when the crane is located in a position at which it will perform lifting tasks.

FIG. 1 illustrates a conventional type of outrigger system 120 commonly referred to as an A-frame outrigger. This outrigger system 120 includes telescoping legs 122 having an upper segment 126 and a lower segment 128. The upper segment 126 is pivotally attached to a support 114 such as the crane superstructure. The lower segment 128 telescopes from the upper segment 126 and interacts with a base surface to support the mobile crane. An intermediate link 124 is pivotably attached to the support 114 at a first end 130 and to the lower segment 128 at a second end 132. A linear actuator, such as a hydraulic cylinder, selectively extends and retracts the lower segment 128 relative to the upper segment 126. The linear actuator may be internal to the upper segment 126 and lower segment 128 and is not visible in FIG. 1.

When the telescoping leg 122 is retracted as shown on the right hand side of FIG. 1, the intermediate link 124 is nearly vertical and the telescoping leg 122 is held close to the mobile crane. As the lower portion 128 of the telescoping leg 122 is extended, the second end 132 of the intermediate link 124 moves with the lower portion 128, rotating the intermediate link 124 outward. The rotating intermediate link 124 pushes the telescoping leg 122 outward, angling the telescoping leg 122, as shown on the left hand side of FIG. 1. Together, the telescoping leg 122, the intermediate link 124, and the support 114 form a fixed triangle. The span of the A-frame outrigger 120 is fixed, dependent upon the geometry of the outrigger.

Another type of outrigger is known in the art as an out-and-down outrigger. An out-and-down outrigger typically includes a telescoping beam that may extended outward from or retracted toward a crane chassis in a horizontal direction (i.e., parallel to a support surface) and a jack extendable from or retractable toward the beam in a vertical direction. Such an outrigger is shown, for example, in U.S. Pat. No. 4,394,912, to Epps et al., the disclosure of which is incorporated herein by reference in its entirety. In an out-and-down outrigger, separate actuators move outrigger pads in/out by actuation of the telescoping beam, and up/down by actuation of the jacks, respectively. An out-and-down outrigger may be advantageous in that they allow the outrigger span to be adjusted independent of the vertical placement of the pad. That is, a vertical position of the jack (or pad) may be adjusted independently of a horizontal position of the beam, and vice versa. However, out-and-down outriggers are necessarily larger than an A-frame outrigger, since they act as horizontal beams supporting the crane, whereas the A-frame outrigger supports the crane nearly in line with the telescoping leg. As such, A-frame outriggers may be advantageous compared to other outriggers in that they are significantly less expensive, they are space efficient, and they require only a single linear actuator. However, as described above, conventional A-frame outriggers are limited to fully extended and fully retracted positions, and thus, do not allow for intermediate positioning for support and stabilization of the crane at multiple extended positions.

Accordingly, it is desirable to provide an outrigger that combines the low cost and reduced complexity of an A-frame outrigger, while allowing the span of the outrigger to be adjustable like an out-and-down outrigger.

SUMMARY

According to one embodiment, a variable span outrigger includes a support having a first pivoting mount and a second pivoting mount, a leg having an upper segment pivotally connected to the support at the first pivoting mount and lower segment having a first plurality of connection points. The outrigger further includes an intermediate member having a first end pivotably connected to the support at the second pivoting mount and a second end, wherein a second plurality of connection points are formed between the first end and the second end of the intermediate member, and a connector configured to selectively couple a first connection point of the first plurality of connection points to a second connection point of the second plurality of connection points.

The variable span outrigger may further include a linear actuator coupled to the upper segment and the lower segment, the linear actuator configured to extend the lower segment relative to the upper segment. The linear actuator may be a hydraulic cylinder, a pneumatic cylinder, and a rack and pinion. The first plurality of connection points may include a plurality of circular apertures, the second plurality of connection points may include a plurality of circular apertures, and the connector may include a pin. The pin may be sized to be received in the circular apertures of the first plurality of connection points and the circular apertures of the second plurality of connection points.

The lower segment may have a cavity sized and shaped to receive the upper segment and the upper segment may nest within the lower segment.

The first plurality of connection points may be formed as three apertures having a common size. The support may be a portion of a mobile crane.

In another embodiment, a mobile crane includes a chassis having a drive system, a first mounting point, and a second mounting point, a boom coupled to the chassis, and a variable span outrigger. The variable span outrigger includes a leg having an upper segment pivotally connected to the chassis at the first pivoting mount and a lower segment movable relative to the upper segment having a first plurality of connection points, an intermediate member having a first end pivotably connected to the chassis at the second pivoting mount and a second end, wherein a second plurality of connection points are formed between the first end and the second end of the intermediate member, and a connector configured to selectively couple a first connection point of the first plurality of connection points to a second connection point of the second plurality of connection points.

A linear actuator may be coupled to the upper segment and the lower segment, the linear actuator configured to extend the lower segment away from the upper segment. The linear actuator may be selected from a hydraulic cylinder, pneumatic cylinder, and rack and pinion. The first plurality of connection points may include a plurality of circular apertures, the second plurality of connection points may include a plurality of circular apertures, and the connector may include a pin. The pin may be sized to be received in the circular apertures of the first plurality of connection points and the circular apertures of the second plurality of connection points.

The lower segment may have a cavity sized and shaped to receive the upper segment and the upper segment may nest within the lower segment. The first plurality of connection points may be formed as three apertures having a common size.

According to another embodiment, a method for adjusting the span of an A-frame outrigger includes retracting a leg of the A-frame outrigger, the leg having an upper segment pivotally connected to a support at a first pivoting mount and a lower segment having a first plurality of connection points, rotating an intermediate member pivotably connected to the support at a second pivoting mount to align a first connection point of the first plurality of connection points of the lower segment to a second connection point of a second plurality of connection points of the intermediate member, rotatably coupling the first connection point to the second connection point with a connector, and extending the leg of the A-frame outrigger by moving the lower segment relative to the upper segment with the intermediate member coupled to the leg.

Rotatably coupling the first and second connection points may include inserting a pin into the first connection point and the second connection point. The first plurality of connection points and the second plurality of connection points may each have three apertures sized and shaped to receive a pin, and the rotatable coupling may include inserting the pin into a middle aperture of each of the first plurality of connection points and the second plurality of connection points.

BRIEF DESCRIPTION OF THE DRAWINGS

To further clarify the above and other advantages and features of the one or more present inventions, reference to specific embodiments thereof are illustrated in the appended drawings. The drawings depict only typical embodiments and are therefore not to be considered limiting. One or more embodiments will be described and explained with additional specificity and detail through the use of the accompanying drawings in which.

DETAILED DESCRIPTION

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

As used herein, "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Various embodiments are set forth in the attached figures and in the Detailed Description as provided herein and as embodied by the claims. It should be understood, however, that this Detailed Description does not contain all of the aspects and embodiments of the one or more present inventions, is not meant to be limiting or restrictive in any manner, and that the invention(s) as disclosed herein is/are and will be understood by those of ordinary skill in the art to encompass obvious improvements and modifications thereto.

Additional advantages of the present invention will become readily apparent from the following discussion, particularly when taken together with the accompanying drawings.

Figure 2:
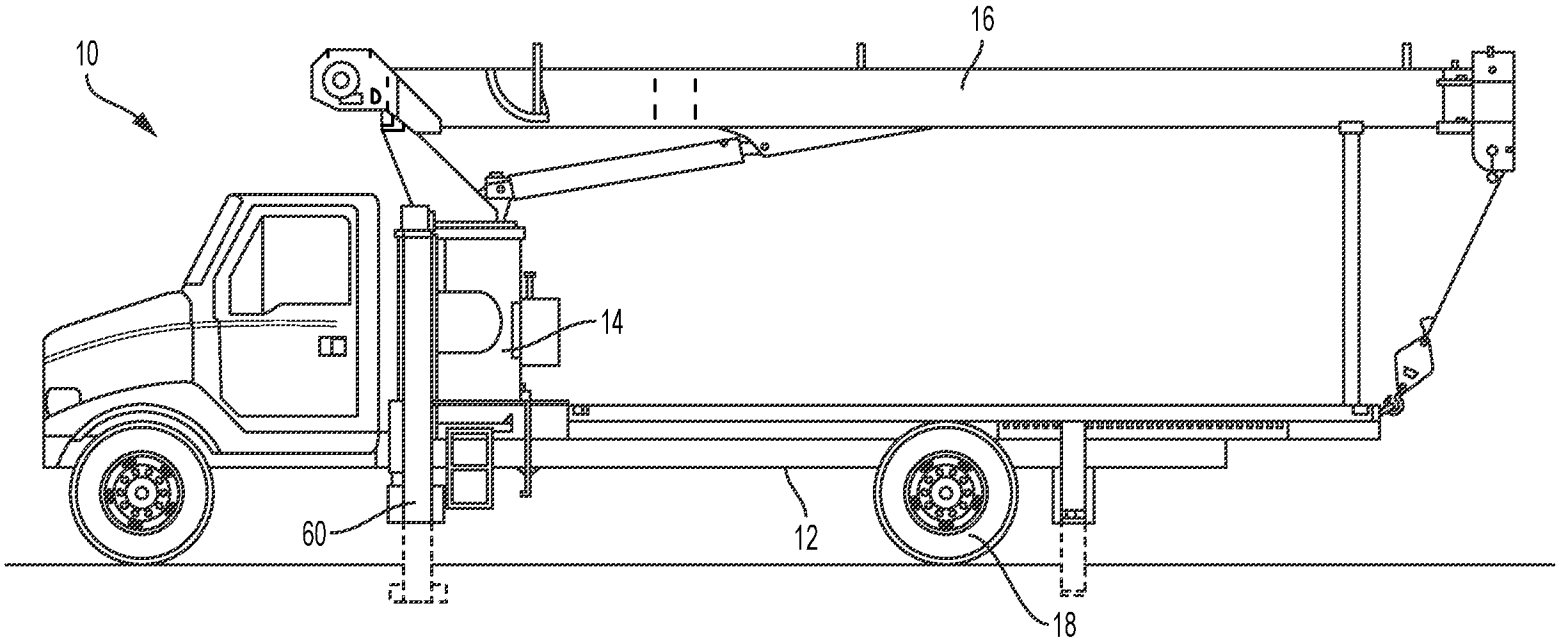
FIG. 2 illustrates a side view of a mobile crane having an outrigger system according to an embodiment described herein.

FIG. 2 is a side view of a mobile crane 10 according to an embodiment described herein. The mobile crane 10 may be, for example, truck mounted crane, including, but not limited to, a boom truck, an industrial crane, and all-terrain crane or a rough-terrain crane. The mobile crane 10 generally includes a chassis 12 and a superstructure 14 supported on the chassis 12. The superstructure 14 may include a boom 16. In one embodiment, the boom 16 is an extendable boom, such as a hydraulic telescoping boom. In a transport mode, the chassis 12 is supported on wheels 18. The mobile crane 10 further includes one or more variable span A-frame outriggers 60. In one embodiment, a variable span A-frame outrigger may be disposed at each side, i.e., the left side and the right side, of the mobile crane 10.

Figure 3:
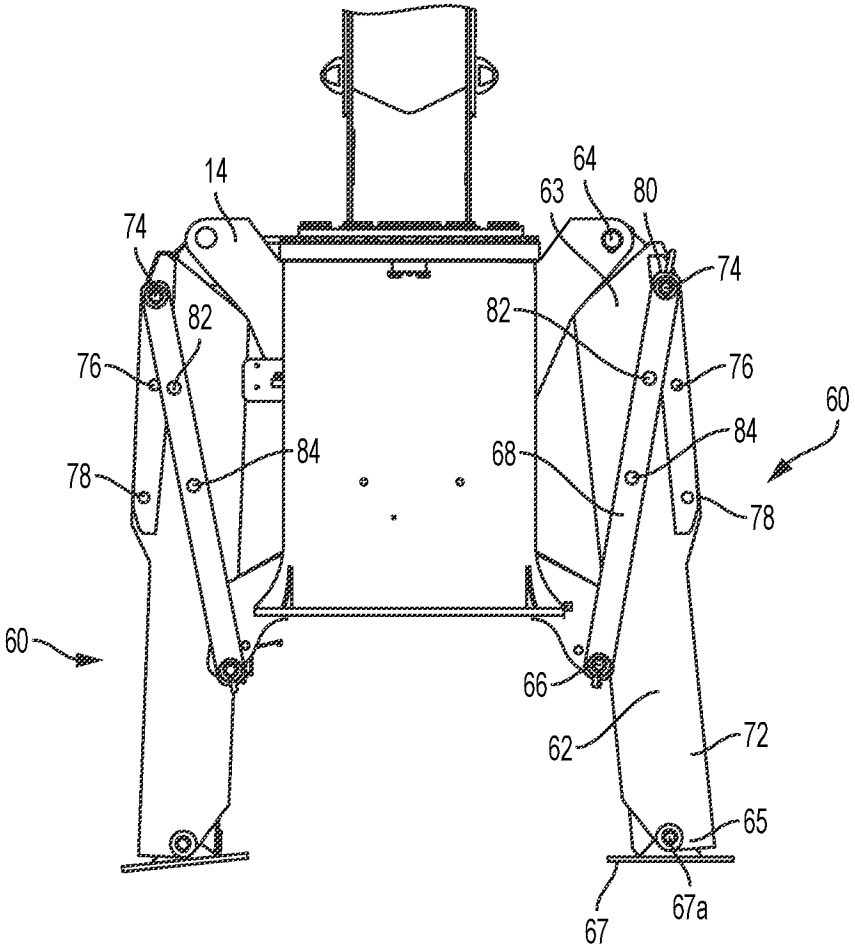
FIG. 3 illustrates an adjustable span A-frame outrigger with the outrigger in a retracted position, according to an embodiment described herein.

FIG. 3 illustrates an example of a variable span A-frame outrigger 60 according to an embodiment described herein. Referring to FIG. 3, the variable span A-frame outrigger 60 includes a telescoping leg 62 having a first end 63 pivotably connected to a support and a second end 65 configured for selective engagement with a support surface. The support may be, for example, the superstructure 14 or chassis 12. In an embodiment, the second end 65 may include a pivotable foot 67 configured for engagement with the support surface. The A-frame outrigger 60 also includes a first pivoting mount 64, a second pivoting mount 66, and an intermediate member 68. The first pivoting mount 64 pivotably connects the first end 63 of the telescoping leg 62 to the support, and the second pivoting mount 66 pivotably connects the intermediate member 68 to the support.

The telescoping leg 62 has an upper segment 70 (shown in FIG. 5) and a lower segment 72. The foot 67 may be pivotably connected to the lower segment 72 at a pivot connection 67*a*. In one embodiment, the lower segment 72 is slidably connected the upper segment 70 for telescoping movement relative to the upper segment 70. In one embodiment, the lower, extendable, segment 72 includes a cavity sized and shaped to receive the upper, fixed, segment 70. The lower segment 72 has a plurality of leg connection points 74, 76, 78 for pivotable connection to the intermediate member 68. In the embodiment of FIG. 3, the lower segment 72 has three connection points. The intermediate member 68 includes a plurality of link connection points 80, 82, 84 for pivotable connection to the leg connection points 74, 76, 78 using known and suitable connection mechanisms, such as selectively removable pins or bolts.

In the embodiments described herein, the variable span A-frame outrigger 60 is movable from a retracted position where the mobile crane 10 is supported on its wheels 18 and may be transported, to a plurality of different extended positions where the A-frame outrigger is extended to at least partially support the mobile crane, for example, during a lifting operation. In one embodiment, the variable span A-frame outrigger 60 is extendable to three extended positions based on connections between different pairs of the leg connection points 74, 76, 78 and link connection points 80, 82, 84.

Figure 4:
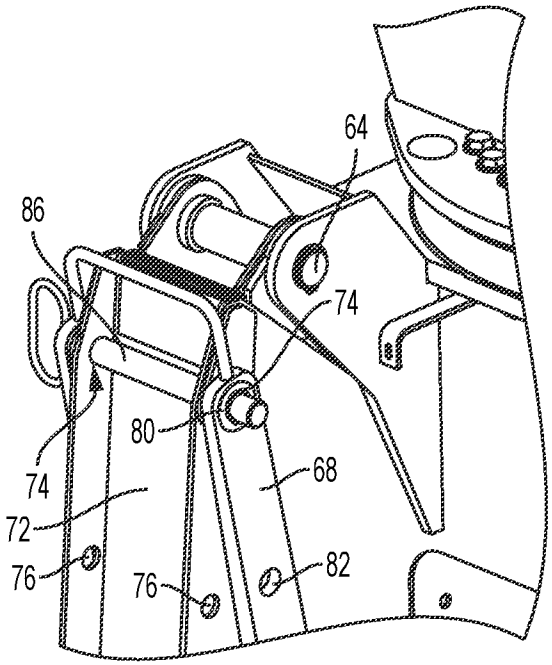
FIG. 4 illustrates an enlarged perspective view of selectable connection points of a lower section of an adjustable leg and an intermediate link on an adjustable A-frame outrigger, according to an embodiment described herein.
Figure 5:
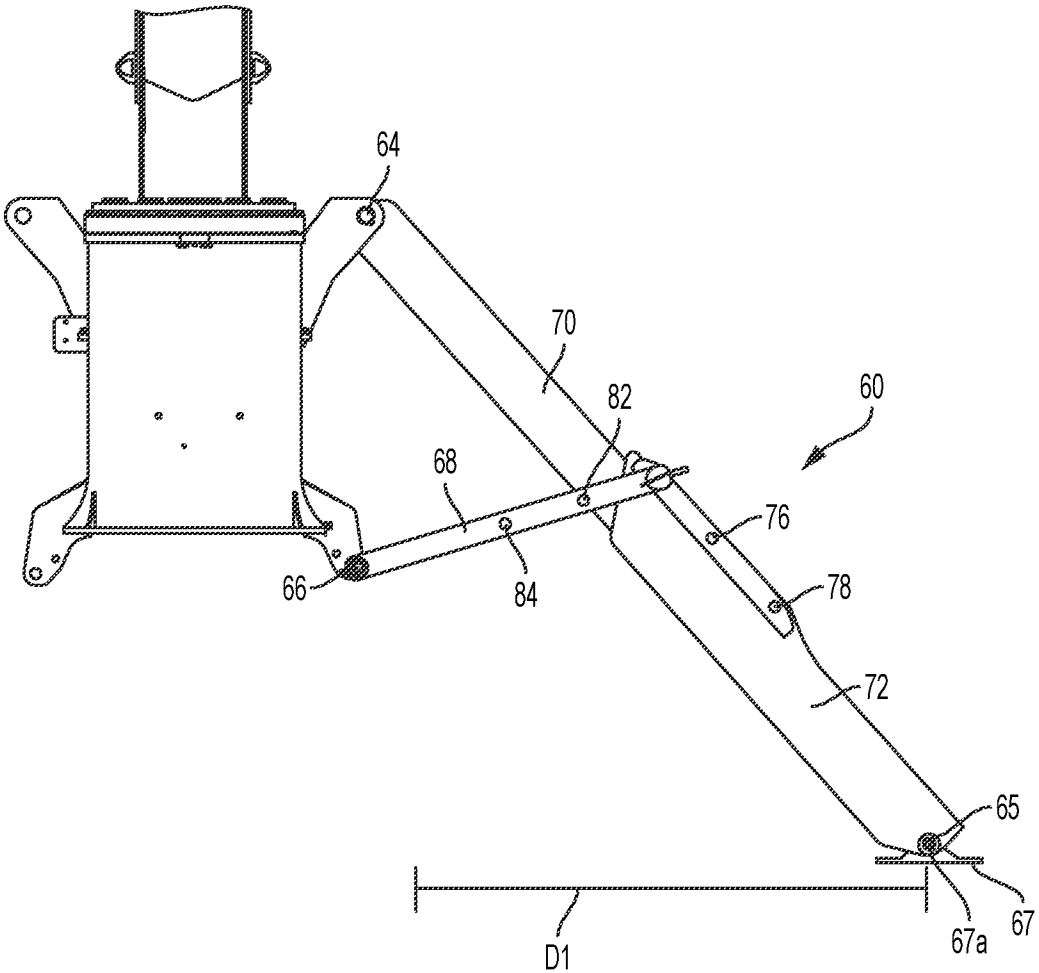
FIG. 5 illustrates the outrigger of FIG. 3 in an extended position with the intermediate link in a full span configuration, according to an embodiment described herein.

In one embodiment, the variable span A-frame outrigger may be configured in a first, or full span configuration by connecting a first leg connection point 74 to a first link connection point 80 (see FIGS. 3-5). The variable span A-frame outrigger may be configured in a second, or intermediate span configuration by connecting a second leg connection point 76 to a second link connection point 82 (see FIGS. 6 and 7). The variable span A-frame outrigger may be configured in a third, or short span configuration by connecting a third leg connection point 78 to a third link connection point 84 (see FIGS. 8 and 9). Other embodiments may have more or less leg connection points and link connection points corresponding to the total number of desired outrigger span configurations, and accordingly, a total number of extended positions. In other embodiments, a leg connection point can be connected to any of the link connection points, and vice versa, to provide additional A-frame outrigger span configurations.

Figure 7:
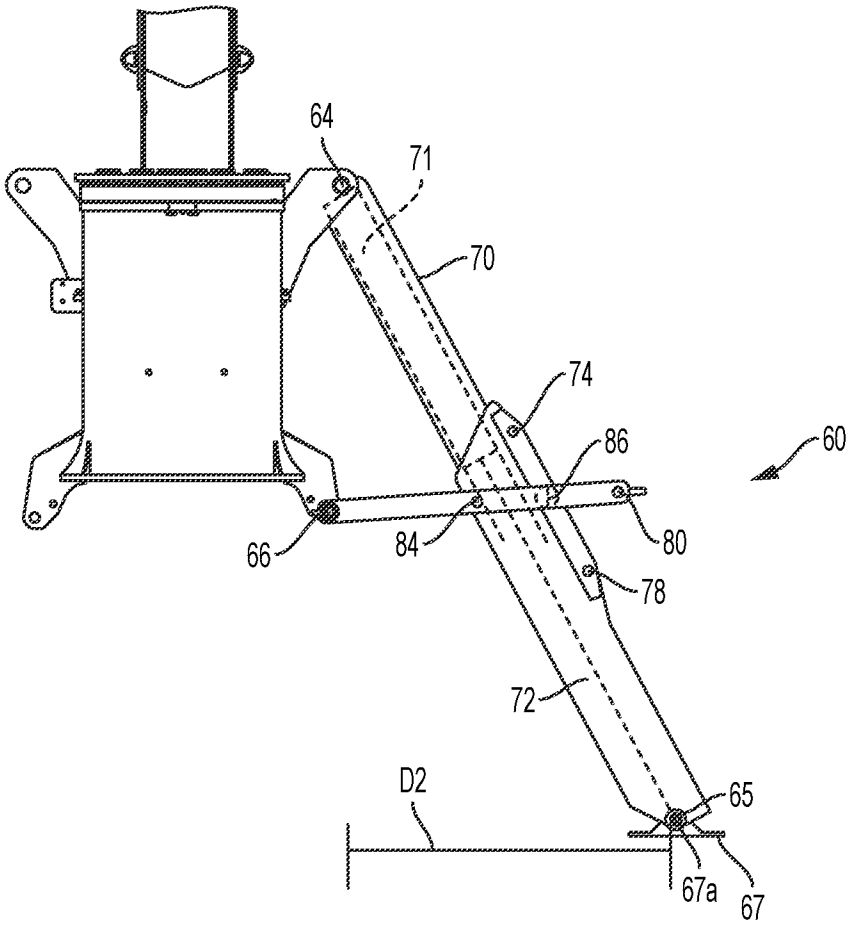
FIG. 7 illustrates the outrigger of FIG. 6 in an extended position with the intermediate link in the middle span configuration; according to an embodiment described herein.

As best shown in FIG. 7, a linear actuator 71 selectively extends and retracts the lower segment 72 relative to the upper segment 70. The linear actuator 71 may be internal to the upper segment 70. The linear actuator 71 may be, for example, a hydraulic cylinder, pneumatic cylinder, rack and pinion, and the like. In an embodiment, the linear actuator 71, at one end, may be pivotably connected to the support (e.g., 12 or 14), for example, at the first pivoting mount 64. The linear actuator 71 may also, at another end, be pivotably connected to the second end 65 of the telescoping leg 62, for example, at the pivot connection 67*a*.

In one embodiment, the number of link connection points 80, 82, 84 of the intermediate member 68 and the number of leg connection points 74, 76, 78 of the lower segment 72 may be equal, with each intermediate member link connection point 80, 82, 84 having a corresponding lower segment leg connection point 74, 76, 78. However, the present disclosure is not limited to such a configuration. For example, one of the lower segment 72 or the intermediate member 68 may include a single connection point, while the other includes a plurality of connection of points.

In the first, or full span configuration, the leg 62 of the outrigger 60 is extendable outwardly a first distance D1. In the second, or intermediate span configuration, the leg 62 of the outrigger is extendable outward a second distance D2. In the third, or short span configuration, the leg 62 of the outrigger is extendable outward a third distance D3. The first, second and third distances D1, D2, D3 may be a lateral or horizontal distance measured from, for example, the first pivoting mount 64, or other common reference point along the horizontal direction, to a center of the leg 62 at the second end 65, for example, the pivot connection 67*a*. In one embodiment, the first distance D1 is greater than the second distance D2, and the second distance D2 is greater than the third distance D3.

In one embodiment, each leg connection point 74, 76, 78 of the lower segment 72 has a corresponding link connection point 80, 82, 84 of the intermediate member 68. The link connection points 80, 82, 84 of the intermediate member 68 are spaced such that each of the link connection points 80, 82, 84 aligns with the corresponding leg connection points 74, 76, 78 of the lower segment 72 dependent on the angular position of the intermediate member 68. In other words, with the lower segment 72 retracted, the first leg and link connection points 74, 80 align with one another when the intermediate member 68 is at a first angular orientation, the second leg and link connection points 76, 82 align with one another when the intermediate member 68 is at a second angular orientation, and the third leg and link connection points 78, 84 align with one another when the intermediate member 68 is at a third angular orientation. Thus, the connection points may be selectively aligned by an operator by rotating the intermediate member 68 about the second connection point 66 with the lower segment 72 in a retracted position.

FIG. 4 illustrates an enlarged perspective view of a connection between the intermediate member 68 and the lower segment 72, according to an embodiment described herein. In the embodiment of FIG. 4, the connection points are circular apertures of substantially equal size. The first link connection point 80 of the intermediate member 68 and the first leg connection point 74 of the lower segment 72 are coupled together in a first configuration by a pin 86 inserted through the circular apertures. The pin 86 pivotably couples the intermediate member 68 and the lower segment 72 together. FIG. 4 additionally illustrates the second link connection point 82 of the intermediate member 68 and the second leg connection point 76 of the lower segment 72. Because the intermediate member 68 connects to the lower segment 72 at the first position, the second leg and link connection points 76, 82 do not align in this configuration. As will be described later, the effective length of the intermediate member 68 may be changed by adjusting the connection point at which the intermediate member 68 and the lower segment 72 are coupled together. This is done by removing the pin 86 from the first leg and link connection points 74, 80, rotating the intermediate member 68 until the second link connection point 82 of the intermediate member 68 aligns with the second leg connection point 76 of the lower segment 72. Once aligned, the pin 86 is inserted into the second leg and link connection points 76, 82 and pivotably couples the intermediate member 68 to the lower segment 72 at the second connection points 76, 82.

FIG. 3 illustrates an example of the variable span A-frame outrigger in a retracted position with the intermediate member 68 connected to the lower segment 72 at the first leg and link connection points 74, 80. This configuration corresponds to a maximum outrigger span configuration described above, wherein the second end 65 of the telescoping leg 62 is extendable to the first distance D1 (FIG. 5). FIG. 5 illustrates an example of the variable span A-frame outrigger of FIG. 3, but with the variable span A-frame outrigger in an extended position. As the lower segment 72 extends from the upper segment 74, the angle of the intermediate member 68 relative to the horizon decreases. Because the location of the second pivoting mount 66 is fixed, the rotation of the intermediate member 68 forces the lower segment 72 outward through the connection point between the intermediate member 68 and the lower segment 72 as the leg is extended.

Figure 6:
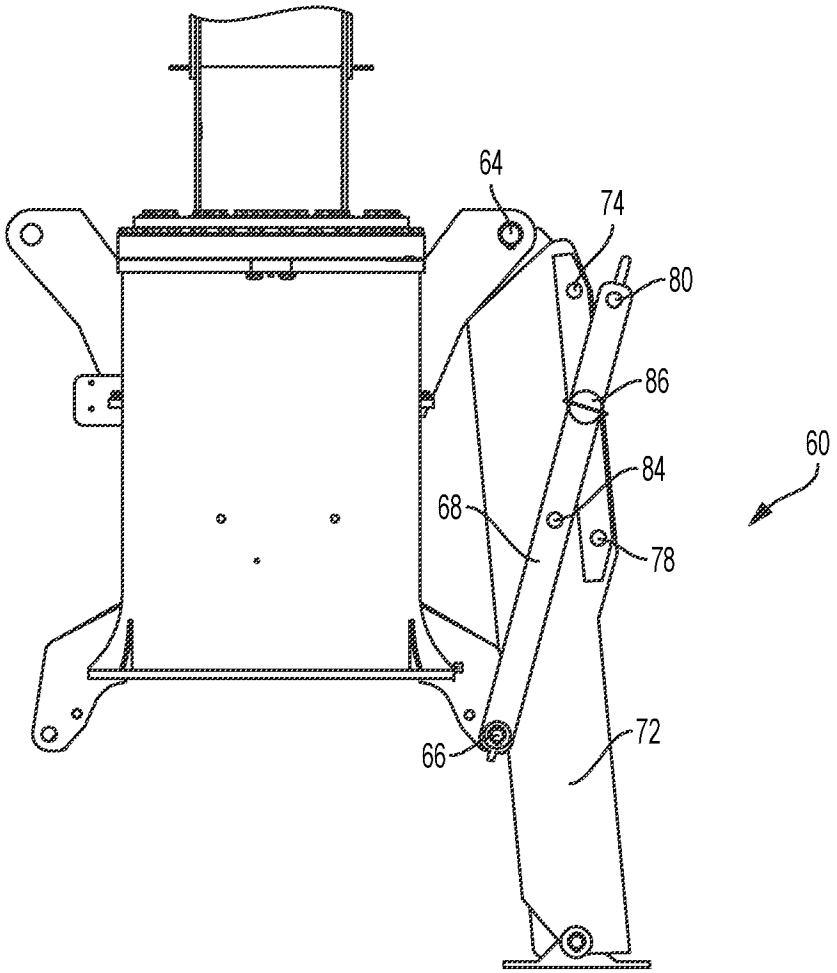
FIG. 6 illustrates the outrigger of FIG. 3 in a retracted position with the intermediate link in a middle span configuration, according to an embodiment described herein.

FIG. 6 illustrates an example of the variable span A-frame outrigger of FIG. 3 in the retracted position, but with the intermediate member 68 being coupled to the lower segment 72 with the pin 86 inserted at the second leg and link connection points 76, 82 (shown more clearly in FIG. 5, for example, in an uncoupled condition). In this configuration, the variable span A-frame outrigger corresponds to an intermediate outrigger span configuration described above, wherein the second end 65 of the telescoping leg 62 is extendable to the second distance D2 (FIG. 7). FIG. 7 illustrates an example of the variable span A-frame outrigger of FIG. 6 in the extended position. In this position, the intermediate member 68 may be nearly horizontal, like the outrigger shown in FIG. 5, but because the pin 86 is located at and connects the second leg and link connection points 76, 82 (shown more clearly, uncoupled, in FIG. 5), the intermediate member 68 does not force the lower segment 72 laterally as far as the configuration of FIG. 5.

Figure 8:
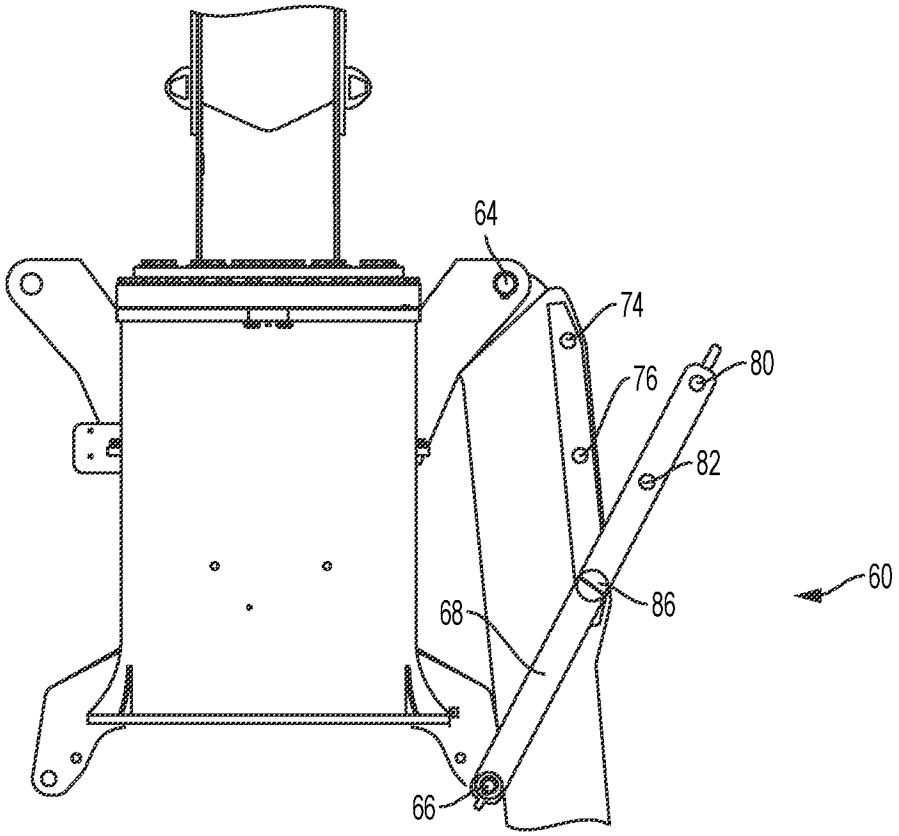
FIG. 8 illustrates the outrigger of FIG. 3 in a retracted position with the intermediate link in a short span configuration, according to an embodiment described herein.
Figure 9:
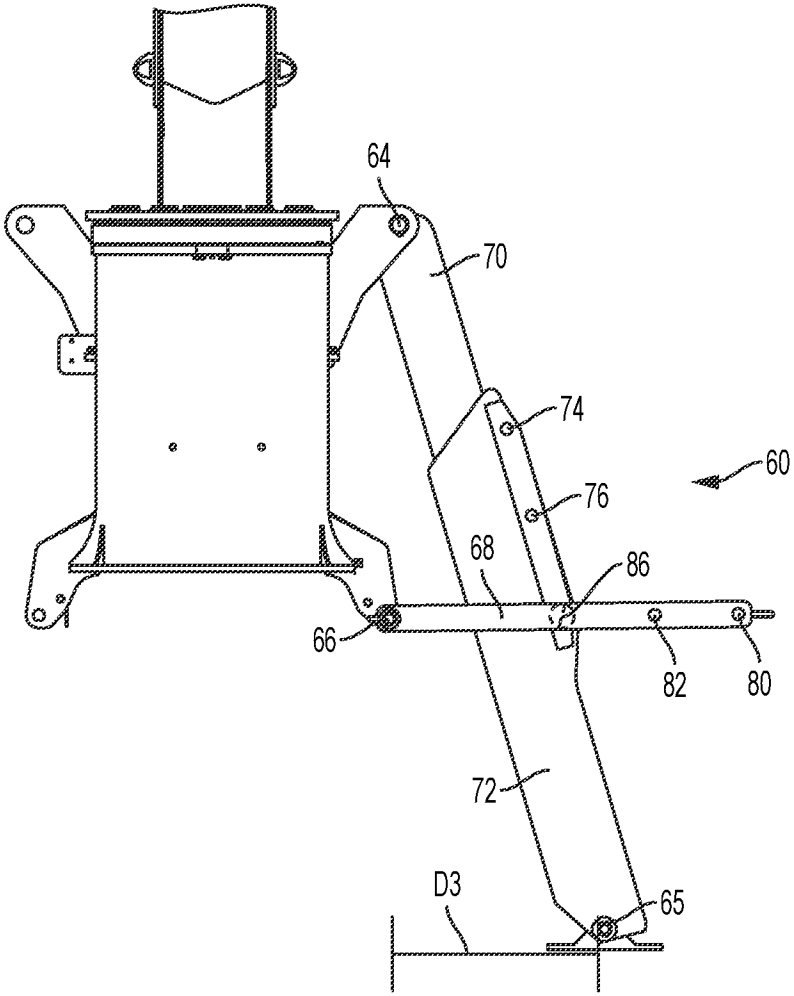
FIG. 9 illustrates the outrigger of FIG. 8 in an extended position with the intermediate link in the short span configuration, according to an embodiment described herein.

FIG. 8 illustrates an example of the variable span A-frame outrigger of FIG. 3 in the retracted position with the intermediate member 68 being coupled to the lower segment lower segment 72 with the pin 86 inserted at the third leg and link connection points 78, 84 (shown more clearly, uncoupled, in FIG. 7). In this configuration, the variable span A-frame outrigger corresponds to the short span outrigger configuration described above, wherein the second end 65 is extendable outwardly to the third distance D3 (FIG. 9). FIG. 9 illustrates an example of the variable span A-frame outrigger of FIG. 6 in the extended position. In the extended position, the intermediate member 68 may be nearly horizontal, like the outrigger shown in FIG. 5 and FIG. 7, but because the pin 86 is located at the third leg and link connection points 78, 84, the intermediate member 68 does not force the lower segment 72 laterally as far as the configurations of FIG. 5 and FIG. 7.

From the foregoing it can be seen that the described embodiments allow for a variable span A-frame outrigger, where the outrigger is extendable to different lengths outwardly from the chassis 12. Moreover, an operator may adjust the span of the A-frame outrigger without moving the outrigger, as the positions of the connection points align when the leg is retracted and the intermediate member is rotatable about second pivoting mount 66. One of ordinary skill in the art will recognize that the number of outrigger configurations may be more or less than the number disclosed. Additionally, while the connector between the intermediate member and the lower segment is disclosed as a pinned connection, other types of connections are possible.

Figure 1:
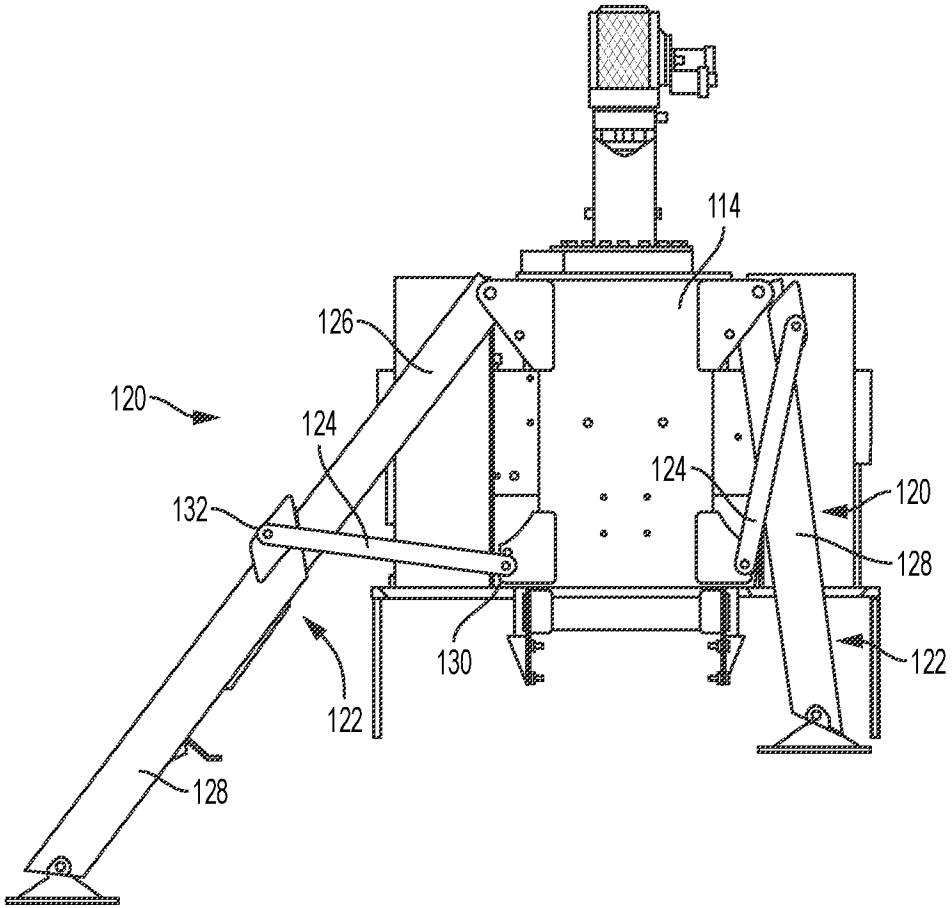
FIG. 1 PRIOR ART
FIG. 1 illustrates a conventional, prior art A-frame outrigger for use with a mobile crane.

In the embodiments above, the variable span A-frame outrigger 60 combines the relative simplicity and low cost of a traditional A-frame outrigger, while allowing for a variable span similar to what is traditionally achieved in an out and down outrigger. Embodiments are suitable as a replacement for most situations in which a traditional A-frame outrigger is used. For example, the variable span A-frame outrigger may be used in a mobile crane such as that shown in FIG. 1.

As described above, it is envisioned that a variable span A-frame outrigger 60 may include outriggers legs 62 at each of the left side and right side of the mobile crane 10. Thus, although some figures omit one of the outrigger legs 62 for clarity (see, for example, FIGS. 5-9), it is understood that the outrigger legs 62 may be included at both sides in these figures, according to embodiments described herein. Further, it is understood that left and right outrigger legs 62 may be identically formed, with the exception of any modifications for use on opposite sides of the mobile crane 10.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A variable span outrigger comprising:

a support having a first pivoting mount and a second pivoting mount;

a leg having an upper segment pivotally connected to the support at the first pivoting mount and a lower segment movable relative to the upper segment having a first plurality of connection points;

an intermediate member having a first end pivotably connected to the support at the second pivoting mount and a second end, wherein a second plurality of connection points are formed between the first end and the second end of the intermediate member; and a connector configured to selectively couple a first connection point of the first plurality of connection points to a second connection point of the second plurality of connection points.

2. The variable span outrigger of claim 1, further comprising a linear actuator coupled to the upper segment and the lower segment, the linear actuator configured to extend the lower segment relative to the upper segment.

3. The variable span outrigger of claim 2, wherein the linear actuator is one of a hydraulic cylinder, pneumatic cylinder, or rack and pinion.

4. The variable span outrigger of claim 1, wherein the first plurality of connection points comprise a plurality of circular apertures, the second plurality of connection points comprise a plurality of circular apertures, and the connector comprises a pin sized to be received in the circular apertures of the first plurality of connection points and the circular apertures of the second plurality of connection points.

5. The variable span outrigger of claim 1, wherein the lower segment has a cavity sized and shaped to receive the upper segment.

6. The variable span outrigger of claim 5, wherein the upper segment nests within the lower segment.

7. The variable span outrigger of claim 1, wherein the first plurality of connection points includes three apertures having a common size.

8. The variable span outrigger of claim 1, wherein the support is a portion of a mobile crane.

9. A mobile crane comprising:

a chassis having a drive system, a first mounting point, and a second mounting point;

a boom coupled to the chassis; and a variable span outrigger comprising:

a leg having an upper segment pivotally connected to the chassis at the first pivoting mount and a lower segment movable relative to the upper segment having a first plurality of connection points;

an intermediate member having a first end pivotably connected to the chassis at the second pivoting mount and a second end, wherein a second plurality of connection points are formed between the first end and the second end of the intermediate member; and a connector configured to selectively couple a first connection point of the first plurality of connection points to a second connection point of the second plurality of connection points.

10. The mobile crane of claim 9, further comprising a linear actuator coupled to the upper segment and the lower segment, the linear actuator configured to extend the lower segment relative to the upper segment.

11. The mobile crane of claim 9, wherein the first plurality of connection points comprise a plurality of circular apertures, the second plurality of connection points comprise a plurality of circular apertures, and the connector comprises a pin sized to be received in the circular apertures of the first plurality of connection points and the circular apertures of the second plurality of connection points.

12. The mobile crane of claim 9, wherein the lower segment has a cavity sized and shaped to receive the upper segment.

13. The mobile crane of claim 9, wherein the upper segment nests within the lower segment.

14. The mobile crane of claim 9, wherein the first plurality of connection points includes three apertures having a common size.

15. The mobile crane of claim 9, wherein the linear actuator is one of a hydraulic cylinder, pneumatic cylinder, or rack and pinion.

16. A method for adjusting the span of an A-frame outrigger, comprising:

retracting a leg of the A-frame outrigger, the leg comprising an upper segment pivotally connected to a support at a first pivoting mount and a lower segment having a first plurality of connection points;

rotating an intermediate member pivotably connected to the support at a second pivoting mount to align a first connection point of the first plurality of connection points of the lower segment to a second connection point of a plurality of second connection points of the intermediate member;

rotatably coupling the first connection point to the second connection point with a connector; and extending the leg of the A-frame outrigger by moving the lower segment relative to the upper segment with the intermediate member coupled to the leg.

17. The method of claim 16, wherein rotatably coupling comprises inserting the connector comprising a pin into the first connection point and the second connection point.

18. The method of claim 16, wherein the first plurality of connection points and the second plurality of connection points each have three apertures sized and shaped to receive the connector comprising a pin, wherein rotatably coupling comprises inserting the pin into a middle aperture of each of the first plurality of connection points and the second plurality of connection points.

* * * * *